US011110364B2

(12) United States Patent
Jonas

(10) Patent No.: US 11,110,364 B2
(45) Date of Patent: Sep. 7, 2021

(54) MOTORIZED AQUATIC TOY WITH ARTICULATED TAIL

(71) Applicant: Buzzbrained LLC, Burien, WA (US)

(72) Inventor: Nicholas Steven Jonas, Normandy Park, WA (US)

(73) Assignee: Buzzbrained LLC, Paradise Valley, AZ (US)

( * ) Notice: Subject to any disclaimer, the term of this patent is extended or adjusted under 35 U.S.C. 154(b) by 0 days.

(21) Appl. No.: 16/526,713

(22) Filed: Jul. 30, 2019

(65) Prior Publication Data

US 2020/0030708 A1 Jan. 30, 2020

Related U.S. Application Data

(60) Provisional application No. 62/711,991, filed on Jul. 30, 2018.

(51) Int. Cl.
*A63H 23/14* (2006.01)
*A63H 29/22* (2006.01)

(52) U.S. Cl.
CPC ..... *A63H 23/14* (2013.01); *A63H 29/22* (2013.01)

(58) Field of Classification Search
CPC ..... A63H 23/14; A63H 29/22
USPC ..... 446/158
See application file for complete search history.

(56) References Cited

U.S. PATENT DOCUMENTS 2,909,868 A * 10/1959 Lewis ..... A63H 23/10 446/139
3,078,617 A * 2/1963 Dempsey ..... A63H 23/06 446/154
D205,457 S 8/1966 Bronte
3,739,520 A * 6/1973 Hill, Jr. ..... A63H 23/04 446/155
4,270,307 A * 6/1981 Arigaya ..... A63H 30/04 440/49
4,687,456 A * 8/1987 Wang ..... A63H 31/00 446/158
4,712,037 A * 12/1987 Verbeek ..... B06B 1/0607 310/321
D296,572 S * 7/1988 Tong ..... D21/585
D296,573 S * 7/1988 Tong ..... D21/585
4,832,650 A * 5/1989 Tong ..... A63H 23/10 43/26.2
4,919,637 A * 4/1990 Fleischmann ..... A63H 23/04 114/333
D325,656 S 4/1992 Davis
D330,575 S 10/1992 Kupperman
D333,854 S 3/1993 Kupperman
5,197,913 A * 3/1993 Suzuki ..... A63H 23/10 273/140
D334,955 S 4/1993 Kupperman
5,282,766 A * 2/1994 Fleet ..... A63H 33/00 446/153

(Continued)

*Primary Examiner* — Melba Bumgarner
*Assistant Examiner* — Dolores R Collins
(74) *Attorney, Agent, or Firm* — Seed IP Law Group LLP

(57) ABSTRACT

A motorized aquatic toy having a body with an attached articulated tail formed of pivotally connected hollow tail segments that maintain directional stability when water is flowing through and around them and having forward offset pivot points with mechanical stops that force contiguous tail segments to pivot in sequence from fore to aft in response to yawing of the body to simulate a life-like pattern of movement with a high level of realism.

17 Claims, 11 Drawing Sheets

(56) References Cited

U.S. PATENT DOCUMENTS 5,344,357 A * 9/1994 Lyczek ..... A63H 23/10 446/154
5,377,439 A * 1/1995 Roos ..... A01M 31/06 43/3
D364,660 S 11/1995 Rahbek
5,474,486 A * 12/1995 Chilton ..... A63H 17/006 222/78
6,113,459 A * 9/2000 Nammoto ..... A63H 17/36 446/431
6,412,210 B1 * 7/2002 Horrell ..... A01M 31/06 43/3
D469,495 S * 1/2003 Greenberg ..... D21/598
6,553,709 B1 * 4/2003 Owen ..... A01M 31/06 43/3
6,790,119 B1 * 9/2004 Chia ..... A63H 23/14 446/158
6,814,634 B2 * 11/2004 Roberts ..... B63H 11/08 440/38
D499,774 S * 12/2004 Dong ..... D21/585
6,910,895 B1 * 6/2005 Gevedon ..... G09B 19/00 434/247
D607,064 S 12/2009 Thorsen
7,727,043 B2 * 6/2010 Whitaker ..... A63H 13/02 446/156
D621,451 S 8/2010 Wong
D622,784 S * 8/2010 Cohen ..... D10/46.2
7,865,268 B2 * 1/2011 Valdivia y Alvarado ..... A01K 85/01 114/332
8,460,051 B2 * 6/2013 Rudell ..... A63H 23/16 446/153
8,997,394 B2 * 4/2015 Baskfield ..... A01M 31/06 43/3
9,463,393 B2 * 10/2016 Olivera ..... A63H 13/02
9,635,850 B2 * 5/2017 Bourlet ..... A01M 31/06
10,086,308 B2 * 10/2018 Mowbray ..... A63H 23/04
D847,272 S * 4/2019 Jonas ..... D21/599
D871,514 S * 12/2019 Weisman ..... D21/608
2013/0017754 A1 * 1/2013 Lu ..... A63H 33/26 446/158
2019/0224581 A1 * 7/2019 Atalla ..... A63H 23/06

* cited by examiner

MOTORIZED AQUATIC TOY WITH ARTICULATED TAIL

BACKGROUND

Technical Field

The present disclosure pertains to functional replica models and, more particularly, to an autonomous or remote control water toy designed to look and behave as a life-like aquatic animal, such as a shark.

Description of the Related Art

Model replicas of living animals, particularly functional replicas, have been utilized for amusement as well as to provide a low-cost alternative to maintaining live animals for show and entertainment. Efforts have been made to provide a high level of realism for not only the static appearance of these devices but also for the way they move and respond to their environment.

Bionics and biomimetics are fields of study that focus on methods and structures, and in some cases the use of mechanics, to emulate living organisms, such as fish, mammals, amphibians, reptiles, and birds. The foregoing animals are classified as vertebrates because they all have a spine. Mechanically replicating the movement of a vertebrate requires the use of complex mechanical structures and control systems. An example is shown in U.S. Pat. No. 2,909,868 for a toy fish. This design is far too complicated for use as a commercial product because it employs complex mechanics to convert the rotary motion of a motor into oscillating motion of the tail fin of the fish. This design will be subject to mechanical breakdowns in view of the large number of parts required to affect the motion of the tail fin. This design also does not describe how the toy may change direction without direct input from a person or external object.

There is a need for a design that provides a high level of realism, particularly for a water-borne toy that utilizes as few mechanical parts as possible and has the ability to swim at or near the surface of the water and change directions using the movement of its tail alone or in combination with other control features.

BRIEF SUMMARY

The present disclosure is directed to a motorized aquatic toy having an articulated tail that moves through the water with a high level of realism. In accordance with one aspect of the present disclosure, an apparatus is provided that has the appearance of an aquatic animal with an articulated tail that moves through the water autonomously or under remote control in which movement of the water through the tail causes the tail to reciprocate laterally.

In accordance with another aspect of the present disclosure, a motorized aquatic toy is provided having a body with an attached articulated tail formed of pivotally connected hollow tail segments with shaped leading and trailing edges that maintain directional stability when water is flowing through and around them, and that further have forward offset pivot points with mechanical stops to force contiguous tail segments to pivot in sequence from fore to aft in response to yawing of the body, which simulates a life-like pattern of movement with a high level of realism In accordance with another aspect of the present disclosure, an aquatic apparatus is provided that includes a buoyant body having a front and a rear, at least one thrust generator on the body to drive the body through water, and an articulated tail depending from the boy. The articulated tail has a longitudinal axis with a plurality of tail segments coupled together with vertical pivot pin hinges to enable lateral articulated movement of the tail in a transverse plane relative to the longitudinal axis of the tail. Each tail segment has a hollow interior, and the forward hinges are off-set forward of the leading edge of each segment to permit the lateral articulated movement of the tail segments relative to one another and to the body.

In accordance with another aspect of the present disclosure, the plurality of tail segments include the plurality of tail segments include a fore tail segment, an aft tail segment and a plurality of intermediate tail segments that are all hingedly attached in series, with the plurality of tail segments each having respective interiors that diminish in size from the fore tail segment to the aft tail segment, and wherein movement of the articulated tail begins with the fore tail segment in response to yawing of the body followed by the plurality of intermediate tail segments and the aft tail segment in sequence from fore to aft.

In accordance with yet another aspect of the present disclosure, each tail segment has a mechanical stop to start an adjacent tail segment pivoting about the vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
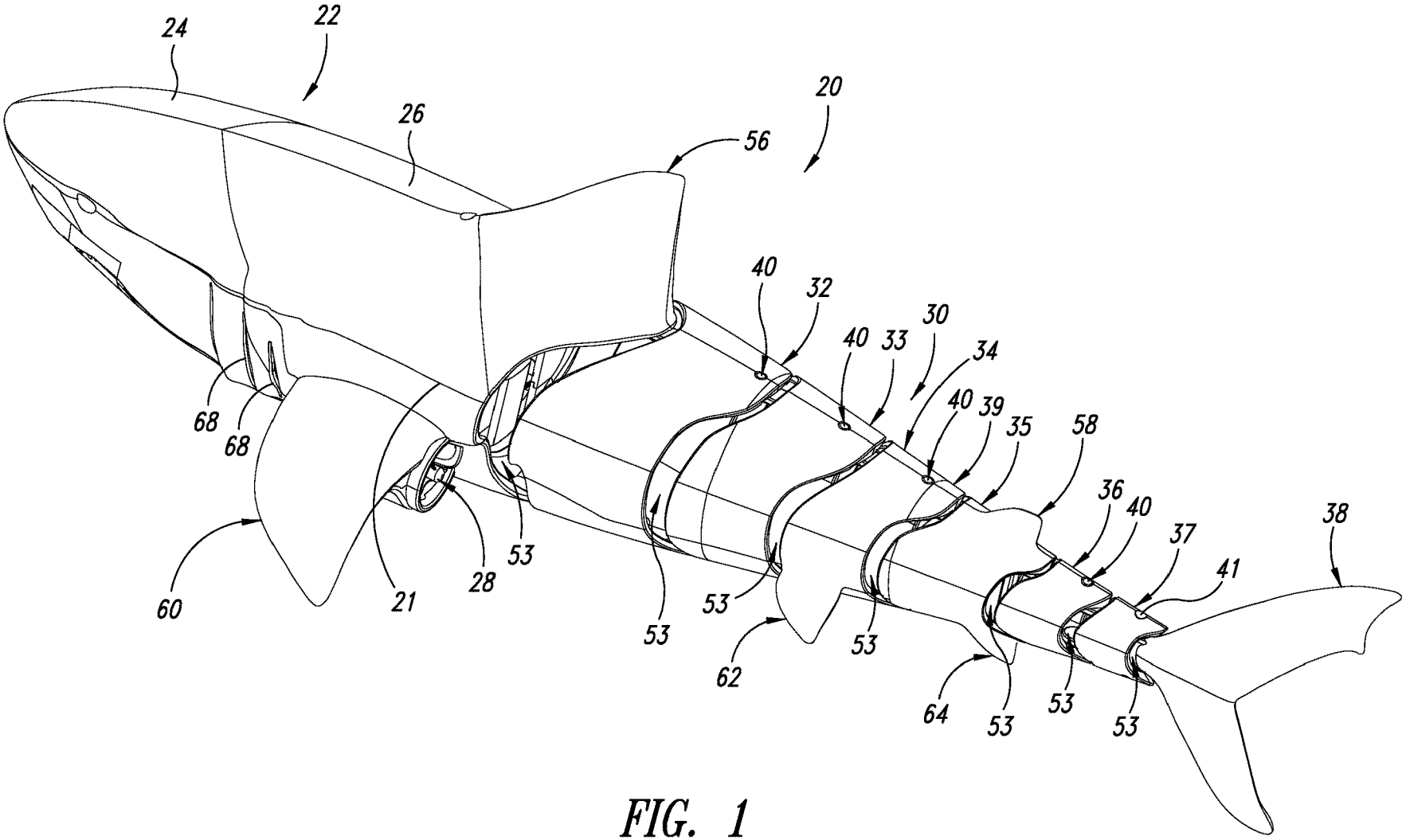
FIG. 1 is an isometric top, right view of an aquatic apparatus formed in accordance with the present disclosure.
Figure 2:
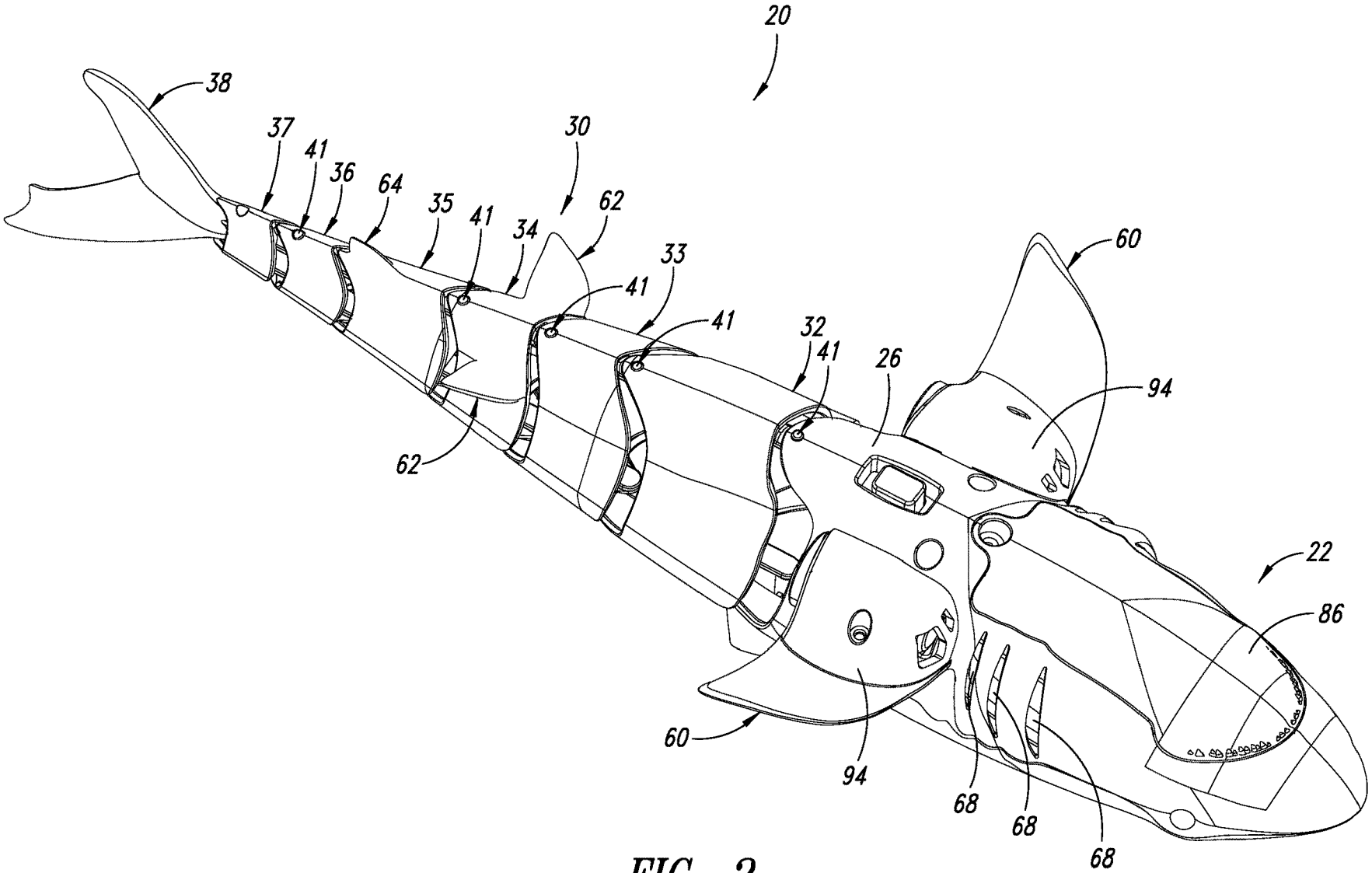
FIG. 2 is an isometric bottom, right view of the aquatic apparatus of FIG. 1.
Figure 3:
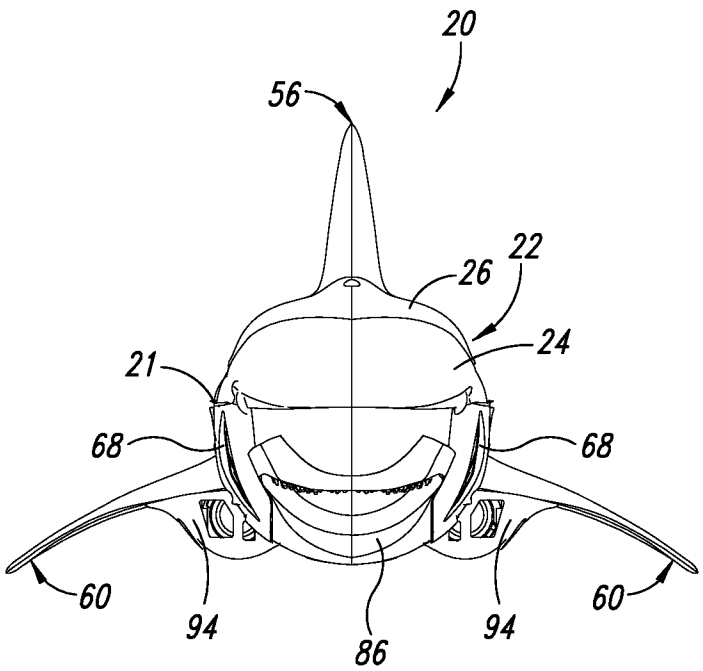
FIG. 3 is a front elevational view of the aquatic apparatus of FIG. 1.
Figure 4:
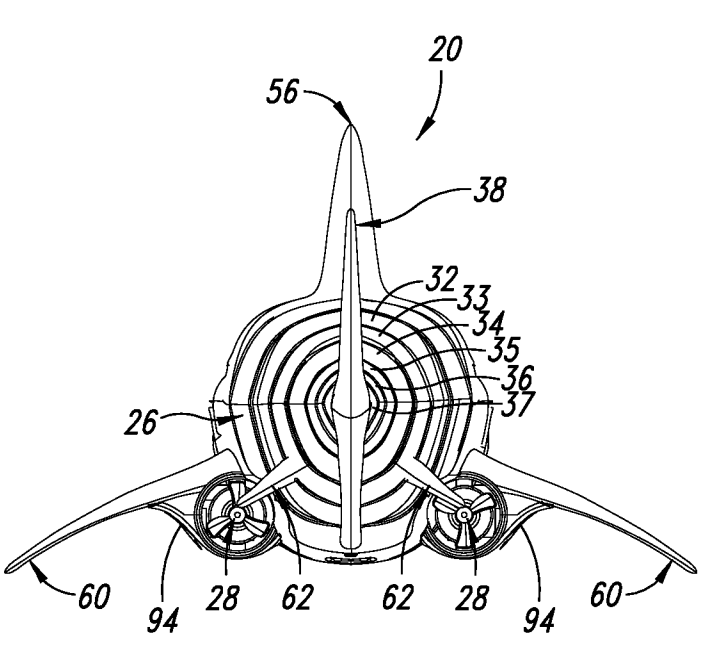
FIG. 4 is a rear elevational view of the aquatic apparatus of FIG. 1.
Figure 5:
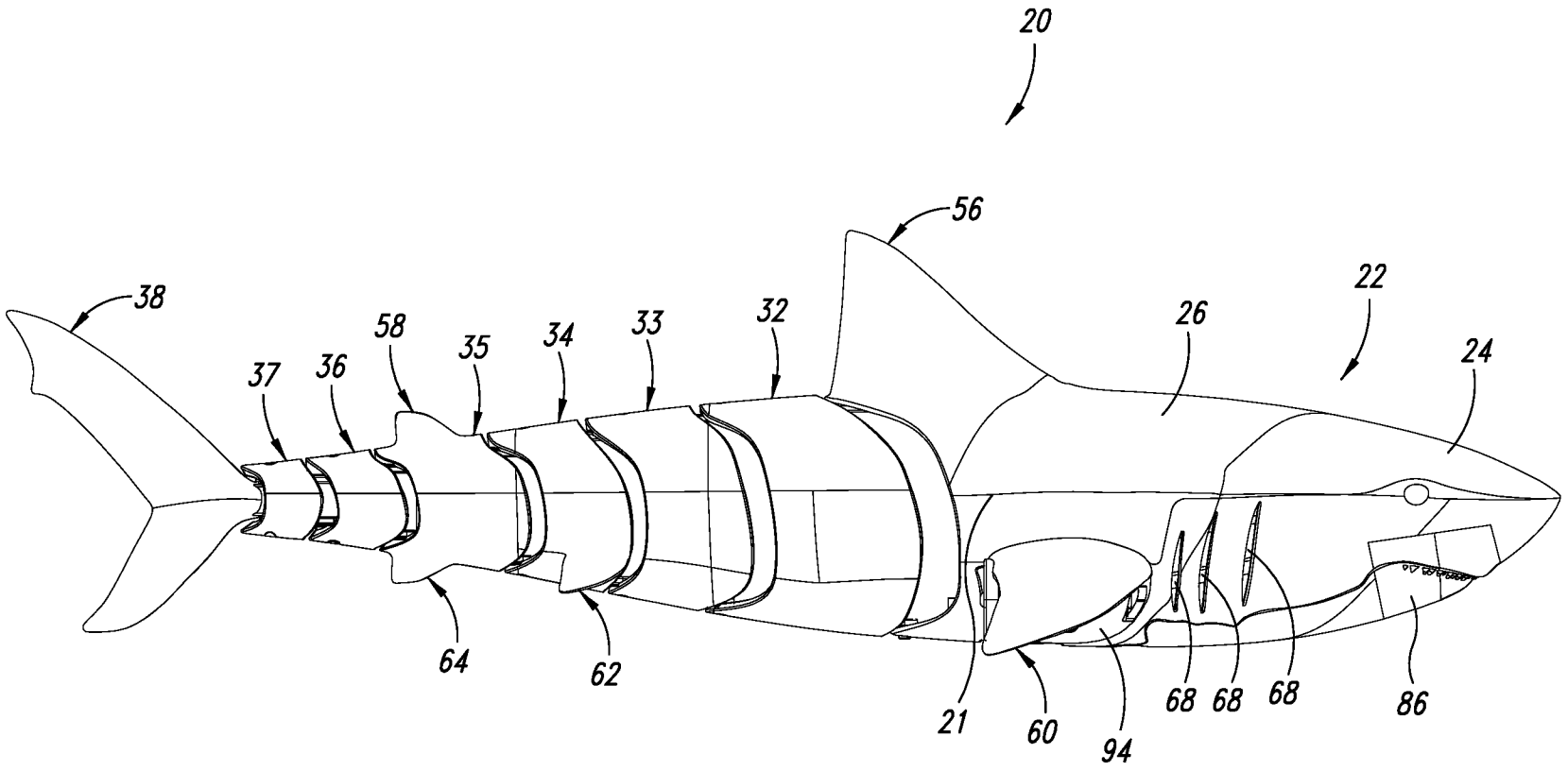
FIG. 5 is a left side elevational view of the aquatic apparatus of FIG. 1.
Figure 6:
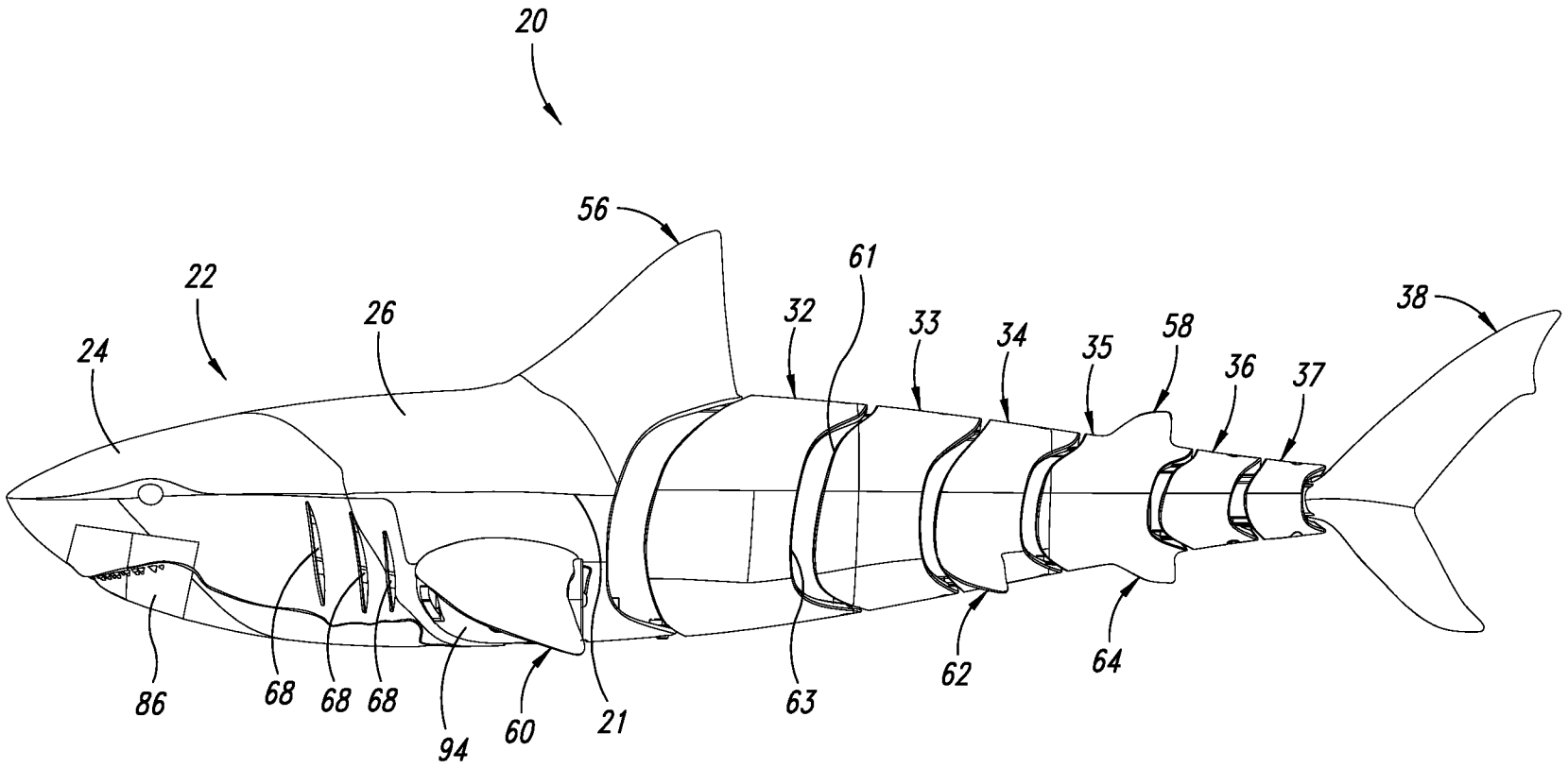
FIG. 6 is a right side elevational view of the aquatic apparatus of FIG. 1.
Figure 7:
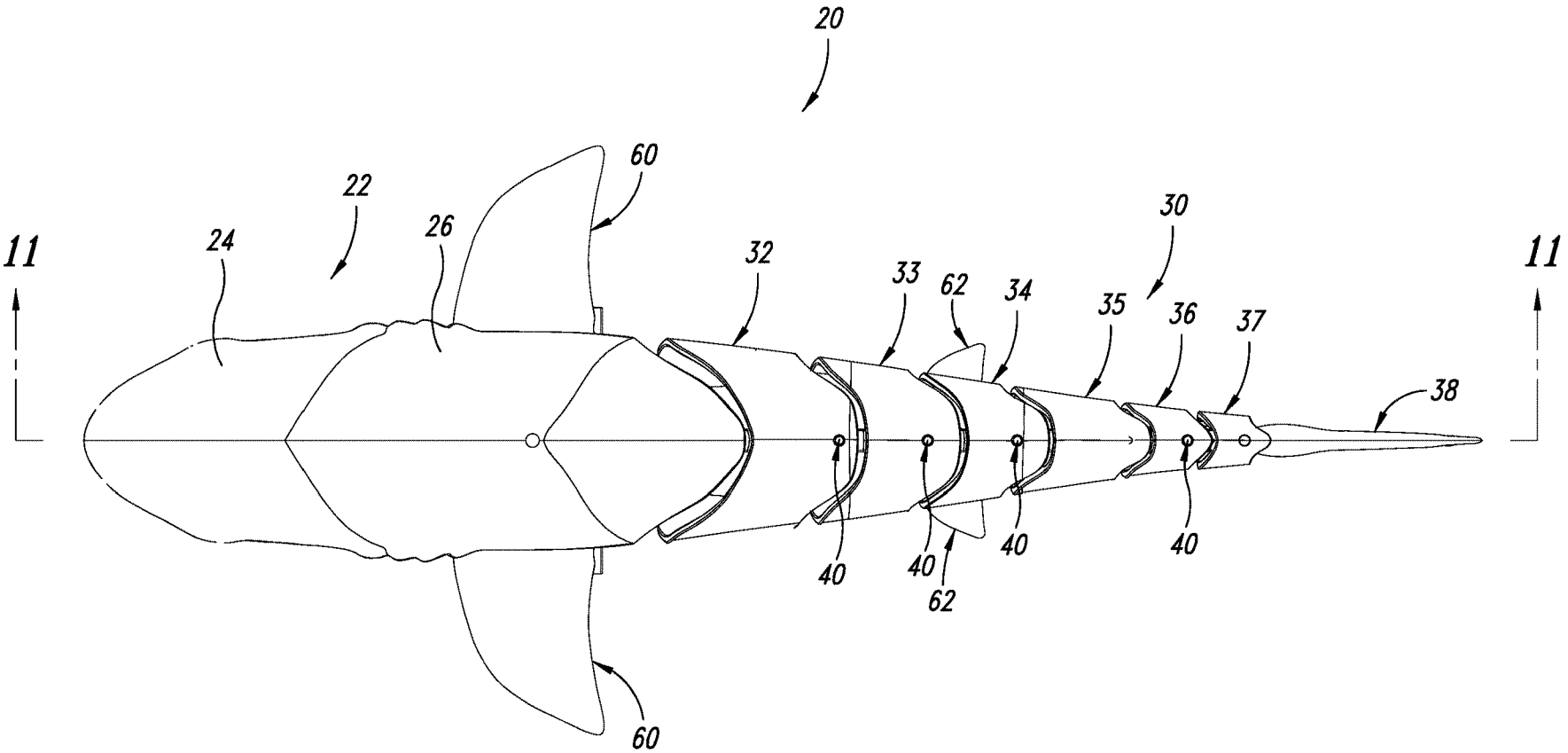
FIG. 7 is a top plan view of the aquatic apparatus of FIG. 1.
Figure 8:
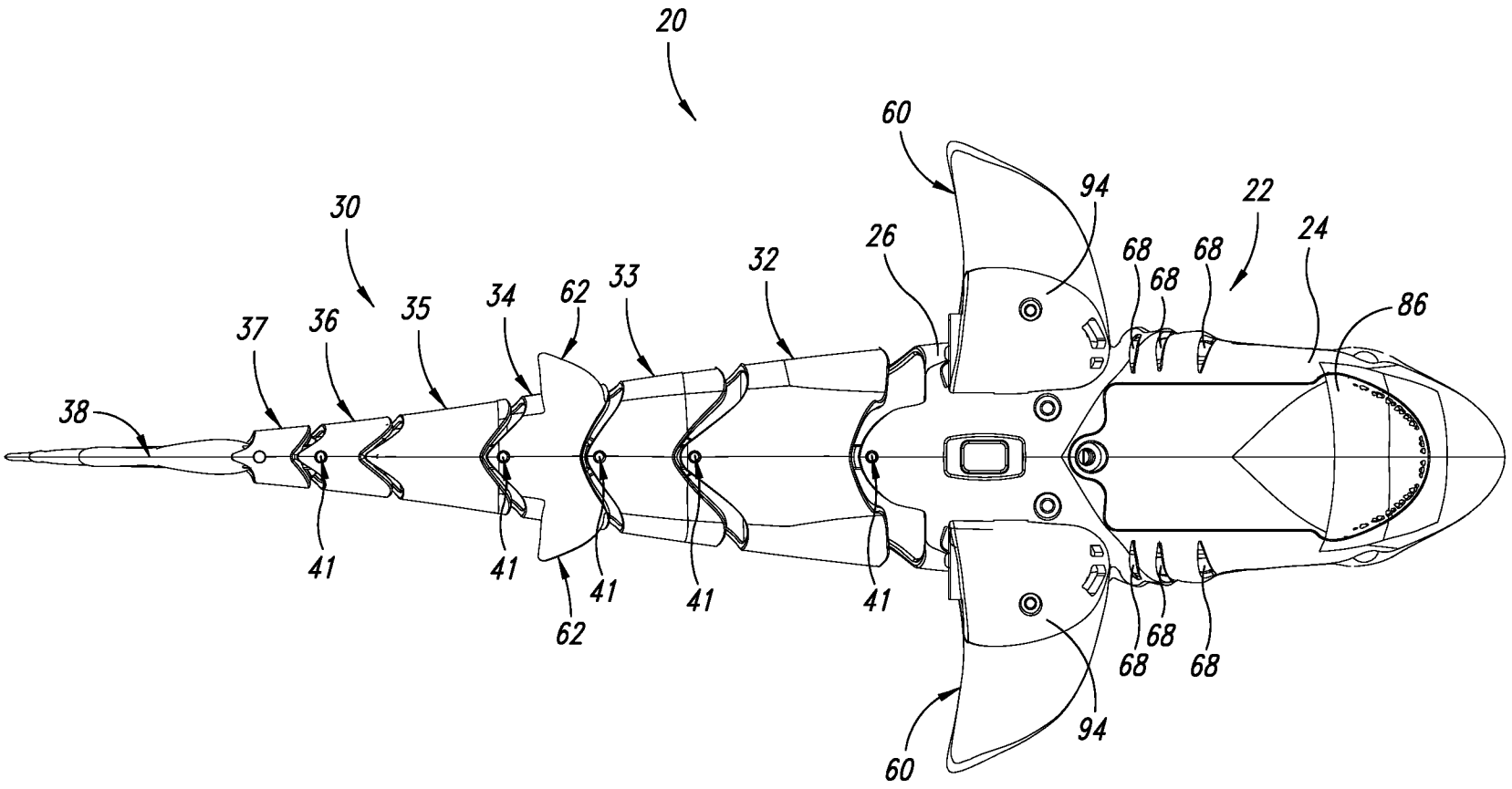
FIG. 8 is a bottom plan view of the aquatic apparatus of FIG. 1.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with molded and extruded plastics, motors, conventional control circuits, propellers, and fasteners or other materials and the like have not been shown or described in order to avoid unnecessarily obscuring descriptions of the various implementations of the present disclosure.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

The Figures are provided (a) to describe further the present disclosure, (b) to show certain implementations or permutations of the present disclosure, and (c) to show enablement, function, and use thereof. In the detailed description of the figures that follows, like elements may be referred to with the same reference number throughout the different implementations of the present disclosure.

Referring initially to FIGS. 1-8, shown therein are various views of an aquatic apparatus 20 formed and assembled in accordance with the present disclosure. The apparatus 20 includes a buoyant body 22 having a head at the front 24 and a trunk at the rear 26, and at least one and preferably two thrust generators in the form of propellers 28 on or within the body 22 to drive the body 22 through water. An articulated tail 30 depends from the body 22 and has a longitudinal axis with a plurality of tail segments, in this case six segments that include a first tail segment 32 coupled to the rear 26 of the body 22, a second tail segment 33 coupled to the first tail segment 32, a third tail segment 34 coupled to the second tail segment 33, a fourth tail segment 35 coupled to the third tail segment 34, a fifth tail segment 36 coupled to the fourth tail segment 35, a sixth tail segment 37 coupled to the fifth tail segment 36, and a caudal fin 38 coupled to the sixth tail segment 37, which are all coupled in series together with vertically oriented hinges to enable lateral articulated movement of the articulated tail 30 in a transverse plane.

Each tail segment 32, 33, 34, 35, 36, 37 has a hollow interior and a dorsal hinge connector 40 and a pelvic hinge connector 41 that includes a dorsal and pelvic hinge pin 42, 44 receivable within a dorsal and pelvic hinge receiver 46, 48 in an adjacent segment. The hinge pins 42, 44 and receivers 46, 48 are structured to provide a gap between each tail segment 32, 33, 34, 35, 36, 37 to permit the lateral articulated movement of the tail segments 32, 33, 34, 35, 36, 37 relative to one another and to the body 22. Also, as shown individually in the exploded view of FIG. 9, a body cavity cap 39 is provided that is fastened to the fourth tail segment 35 in a manner that provides an airtight and watertight seal and creates a buoyancy chamber 43 inside the fourth tail segment 35.

Each tail segment 32, 33, 34, 35, 36, 37 has a leading edge 50 and a trailing edge 52, each of the leading edges 50 having an angled face 54. In a representative implementation, the dorsal and pelvic hinge connectors 40, 42 are structured to have the dorsal and pelvic hinge connectors offset forward of a top and bottom section of the leading edge 50 of each tail segment 32, 33, 34, 35, 36, and 37. This creates gaps 53 between each of the tail segments 32, 33, 34, 35, 36, and 37 as well as the body 22 and tail fin 38 that allow water to flow through the hollow interiors of the segments 32, 33, 34, 35, 36, and 37 and past the exterior to stabilize the tail segments 32, 33, 34, 35, 36, and 37 and resist turning or pivoting of each of the tail segments 32, 33, 34, 35, 36, and 37.

The plurality of tail segments 32, 33, 34, 35, 36, 37 and the caudal fin 38 are structured to cooperate with each other when assembled together and to the body to respond to water flowing through the tail segments 32, 33, 34, 35, 36, 37 and past the caudal fin 38, and past the leading and trailing edges 50, 52 of each tail segment 32, 33, 34, 35, 36, 37 to maintain stability and resist pivoting or turning about the hinge connectors when moving through the water. When the body 22 yaws in a first or second lateral direction, the plurality of tail segments 32, 33, 34, 35, 36, 37 will each turn or pivot in the same direction about the dorsal and pelvic hinge connectors 40, 41 in sequence from fore to aft to display coordinated lateral oscillation of the articulated tail 30 in a life-like pattern of movement.

The apparatus 20 includes various features that add to the life-like appearance of the toy, which in this case resembles a shark. These features include a first dorsal fin 56 on the trunk 26, a second dorsal fin 58 on the fourth tail segment 35, pectoral fins 60 on both sides of the third tail segment 34, pelvic fins 62 on both sides of the trunk 26, and an anal fin 64 on the fourth tail segment 35. In addition, gills 66 are formed on both sides of the trunk 26, preferably three, which are sized and shaped to appear realistic. In addition to the cosmetic appearance of the gills 66, in one implementation one or more of the gills 66 include an opening 68 to permit the passage of water into and out of the trunk 26. Water entering the gills 66 fills the body 22, permitting it to partially submerge into the water for balance and stability. Ideally the apparatus 20 will submerge until the dorsal fin 56 and part of the top of the body are visible. In accordance with another aspect of the present disclosure, the apparatus can have a draft that is about at a midline 21 of the body 20, or it can vary as the apparatus is moving in the water between the midline 21 and the top of the body 22. An optional opening in the top of the body can be formed to permit air to escape the body and water to enter more quickly, as is described more fully below and in connection with FIG. 12.

It is to be understood that while a shark has been illustrated and described in a representative embodiment of the present disclosure, other aquatic vertebrates may be utilized for implementation of the present disclosure and that the shark depicted in these drawings is for illustrative purposes only. For example, Koi fish are a favorite decorative fish for use in artificial ponds and streams, and the principles of design, construction, and operation disclosed herein may be utilized by one of ordinary skill in this technology to construct and use a Koi fish.

Figure 9:
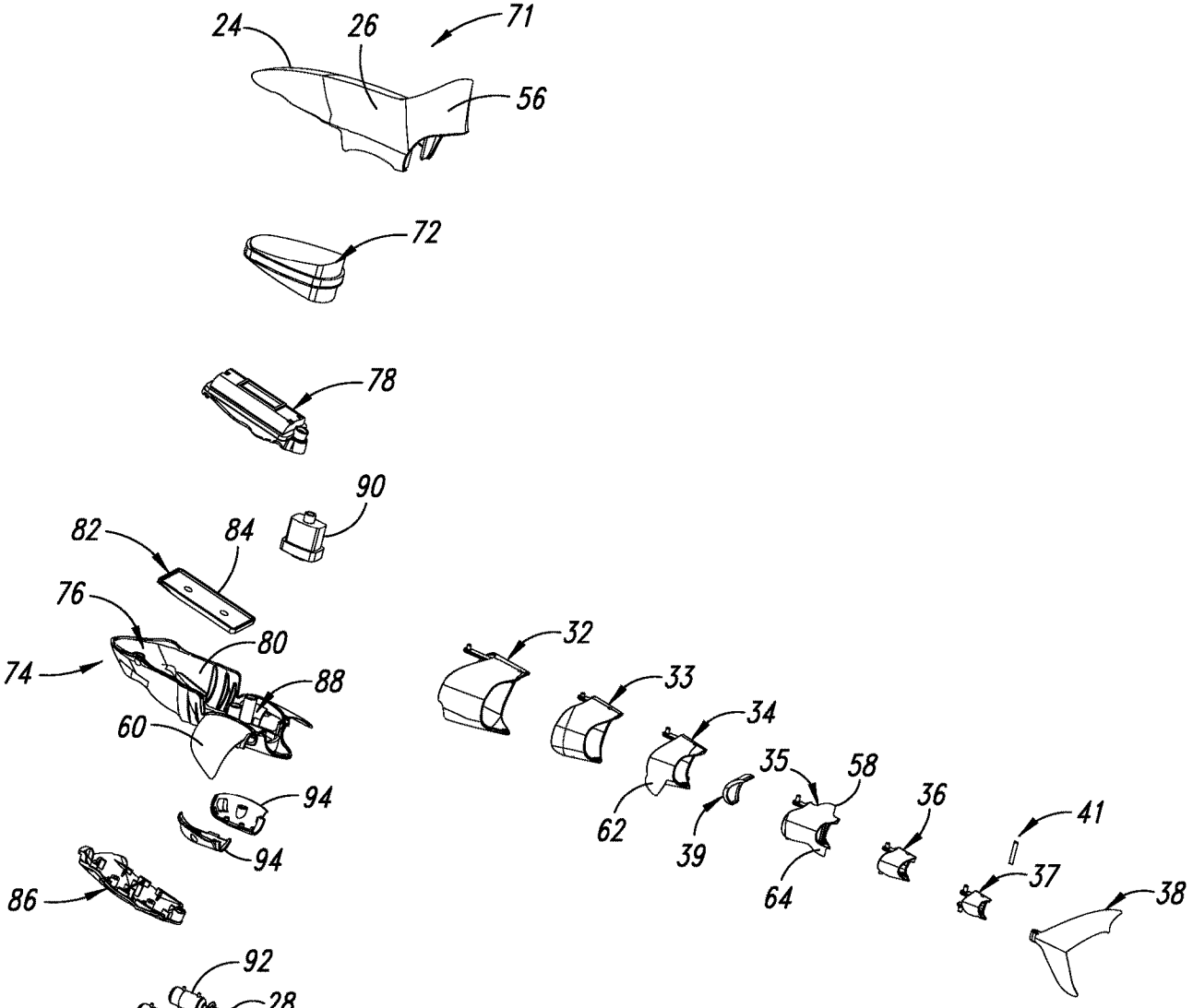
FIG. 9 is an exploded pictorial view from an upper, left, rear of the aquatic apparatus of FIG. 1.
Figure 10:
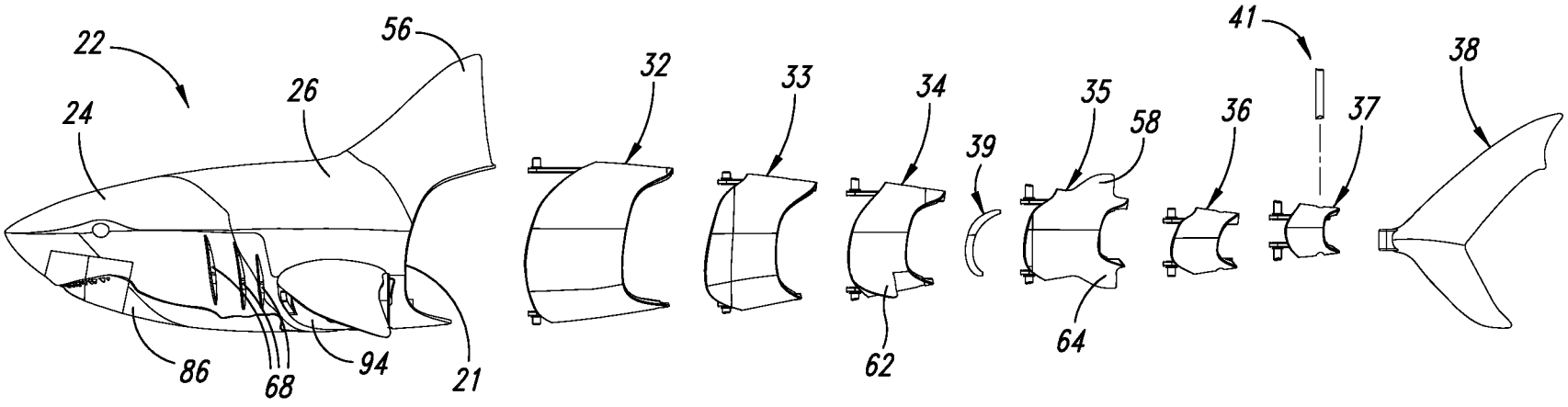
FIG. 10 is an exploded pictorial view from an upper, right, front of the aquatic apparatus of FIG. 1.
Figure 11:
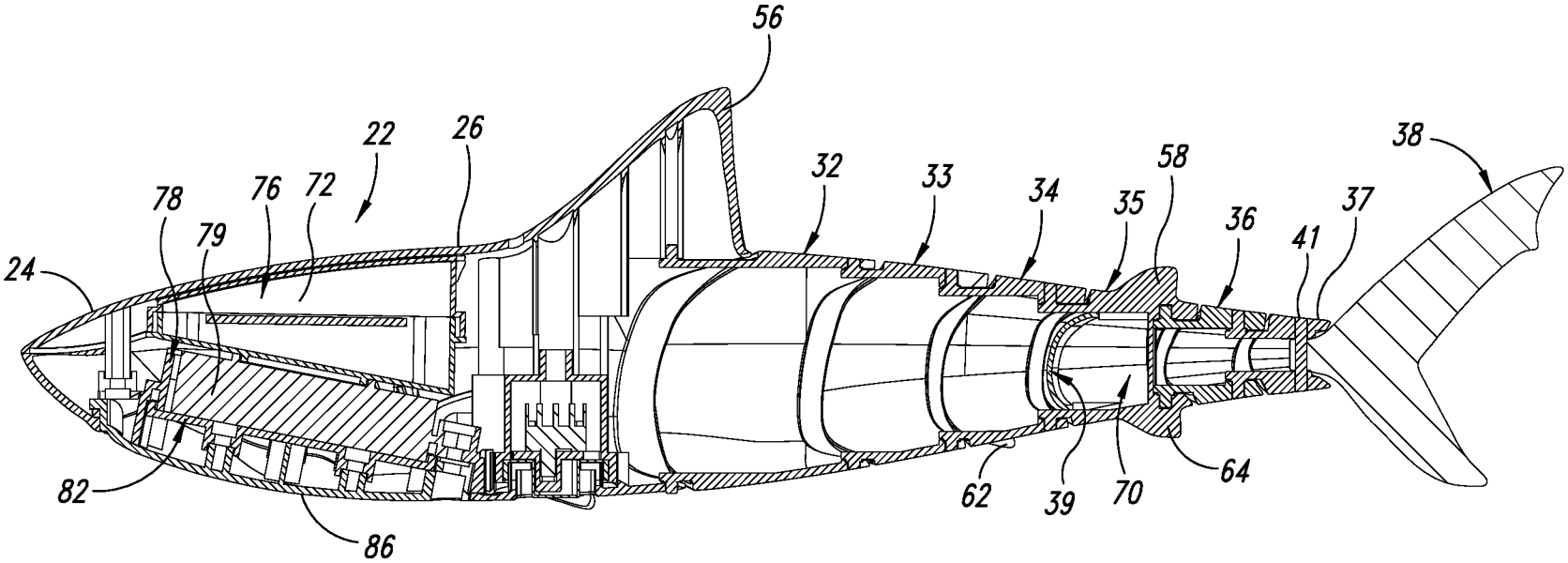
FIG. 11 is a longitudinal cross-sectional view along lines 11-11 of the aquatic apparatus of FIG. 6.

FIGS. 9-11 illustrate more details about the appearance, construction, and operation of the apparatus 20.

In order to provide longitudinal stability and balance to the apparatus 20 along its longitudinal axis, a flotation device 70 is provided in the tail 30. In one implementation, the flotation device 70 consists of an air cavity or pocket that is provided in one or more of the tail segments 32, 33, 34, 35, 36, 37. The cavity or pocket may be integrally formed in one or more of the tail segments 32, 33, 34, 35, 36, 37. In this implementation as shown in the cross-section view of FIG. 11, it is formed in the fourth tail segment 35 by attaching a cover or cap 39 with an adhesive to form an airtight and watertight seal. In another implementation the flotation device 70 can be a sealed air bladder that is attached to one or more of the tail segments 32, 33, 34, 35, 36, 37. It is to be understood that other forms of providing buoyancy to the tail 30 can be used, such as buoyant material, including without limitation Styrofoam, and other materials that are readily commercially available. The buoyancy and placement of the flotation device 70 will depend on the size of the apparatus 20 and the degree of imbalance when the apparatus 20 is in the water. It is to be noted that the size and placement of the flotation device 70 needs to be selected so there is no interference with water flowing through the tail segments 32, 33, 34, 35, 36, 37 such that the action of the tail 30 in the water is inhibited, does not experience full travel in both directions, and is less than realistic. For the representative implementation illustrated and described herein, the placement of the flotation device 70 would be in the fourth tail segment 34.

The exploded view of FIG. 9 also shows the body 22 having a body cover 71, formed as a single piece, and a single-piece body housing 74 with a body cavity 76 defined as the enclosed space between the body cover 71 and body housing 74.

An electronics casing 72 is sized and shaped to fit within the body cavity 76. This casing 72 contains a control board, antennae, and wiring. In accordance with one aspect of the present disclosure, the electronics components casing is made of two pieces that are fitted together and sealed with adhesive and silicone to maintain an airtight and watertight compartment inside for housing the circuit board, antennae, and wiring. A battery compartment 78 houses one or more batteries 79 that provide power to the electronic components. It is attached inside a forward compartment 80 of the body housing 74 from the inside during assembly. A battery cover 82 with a circumscribing seal 84 is attached to the exposed underside of the battery compartment to prevent water from getting into the battery compartment. A battery cover outer shell 86 is also provided that attaches to the body housing 74 to cover the access opening to the battery cover 82. Water is permitted to enter the body housing 74 between the battery cover outer shell 86 and the battery cover, but not past the battery cover 82 and to the battery 79. An optional opening may be formed in the battery cover outer shell 86 to enable water to enter the body 22 as described above with respect to the gills 66.

This construction provides buoyancy to the apparatus because the forward compartment 80 holds air because it is sealed with the seal 84. The main body cover 71 also holds some air that gets trapped in the dorsal fin 56 because it has a cavity therein, as well as air that is inside a top area of the body cover 71 and in the body cavity 76. The battery compartment 78 is water tight and will hold air when the battery cover 82 is in place.

Figure 12:
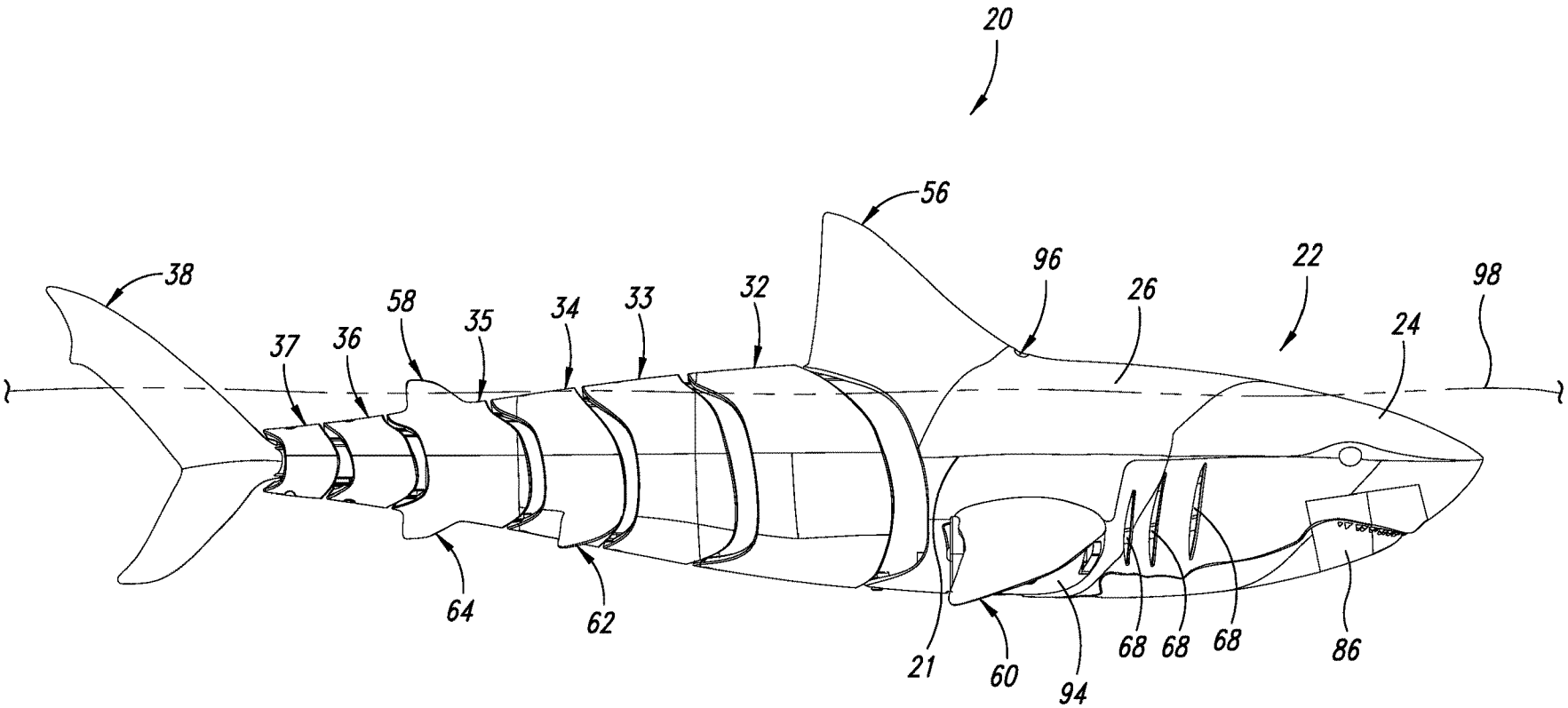
FIG. 12 is an illustration of the draft of the aquatic apparatus when in the water.

FIG. 12 shows the ideal draft for one implementation of the aquatic apparatus 20 in the water 98. The body cover 71, however, is designed to allow water to partially fill and flow through it to keep it less buoyant and get the correct floating level to the apparatus. Ideally, the apparatus sits in the water with the back (top of the body cover 71) just barely out of water, and the dorsal fin 56 is fully exposed with the tail or caudal fin 38 tip showing at times. An opening or one or more openings 96 of one or a variety of sizes can be placed in the top of the body cover 71 in a variety of locations to aid in allowing air to escape from the body cover 71 as well as the body cavity 76.

The body housing 74 also has an aft compartment 88 in which is mounted an on/off switch 90 having a watertight housing and which is electrically coupled to the battery 79 and the above-listed electronic components inside the electronics components casing 72. Also mounted inside the aft compartment 88 are two electric motors 92 that are coupled to the propellers 28 to rotate the propellers. The electric motors 92 are also electrically coupled to the on/off switch 90 and via the switch to the electronic components inside the electronics components casing 72. One pair of left and right motor-and-propeller covers 94 attach to the exterior of the aft compartment 88 on the body housing 74 to act as cowls for the propellers 28 in a manner that is known to those skilled in the art.

The pectoral fins 60 may be cupped or have a camber to their construction so as to provide lift to the body 22 and the entire apparatus 20 when it moves through the water. For the best stability, the longitudinal center of gravity should be located through the pectoral fins.

Ideally, each of the tail segments 32, 33, 34, 35, 36, and 37 are shaped with a leading edge 50 side cut 61 on each side that initially goes forward and downward to the midline 21, and then starts to turn aftward from the midline to the bottom. A trailing edge 52 side cut 63 is formed to likewise match the adjacent leading edge side cut 61, i.e., that initially goes forward and downward to the midline 21, and then starts to turn aftward from the midline to the bottom. Each tail segment 32, 33, 34, 35, 36, and 37 has a mechanical stop to start an adjacent tail segment pivoting about the vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction. In the illustrated implementation, the side cuts 61, 63 and resulting shape of the leading edge 50 and trailing edge 52 of each of the tail segments 32, 33, 34, 35, 36, and 37 function as the stops to determine the amount of pivoting or rotation of each tail segment. These adjacent elements will contact each other at the side cuts 61, 63 to limit travel and to initiate travel, depending on the orientation of the segments vis-à-vis the body 22. The shape of the cuts is a matter of design choice and will be selected to enhance the cosmetic appearance of the toy 20.

In another aspect of the present disclosure, the aquatic apparatus can be configured for remote control, particularly wireless remote control such as is done with remote control toy cars, airplanes, etc. One method of control is to use differential thrust of the two motors 92 and propellers 28, which controls the yaw of the apparatus 20 in the water 98. To enhance reception of wireless control signals, the receiving antenna on the apparatus 20 can be placed inside the dorsal fin 56. The apparatus 20 can also be autonomous, meaning it can be configured to swim in a random pattern or a preset pattern using electronic controls of the motors 92. Alternatively, proximity sensors can also be provided that detect the proximity of an object and control signals can be generated in response to the sensing to cause the apparatus 20 to yaw and turn away from the object. These various control methods can be implemented using conventional electronic components that are readily commercially available.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. An aquatic apparatus, comprising: a buoyant body having a front and a rear; at least one thrust generator on the body to drive the body through water and to cause the body to yaw about a vertical axis; an articulated tail without thrust depending from the body, the articulated tail having a longitudinal axis and including at least five tail segments, each tail segment having a shaped leading edge and a shaped trailing edge, a hollow interior, upper and lower aft hinge points, and upper and lower forward hinge points extending forward of the leading edge to couple to a respective upper and lower aft hinge point of an adjacent tail segment and providing a gap between each respective tail segment to permit water to flow through the hollow interior of the at least five tail segments and maintain directional stability, and each tail segment further including mechanical stops that cause lateral articulated movement of the at least five tail segments relative to one another and to the body in response to yawing of the body to display coordinated, sequential lateral oscillation of the articulated tail in a life-like pattern of movement in response to yawing of the body; and a buoyancy chamber formed in a fourth tail segment of the at least five tail segments depending from the body with a fore tail segment being attached to the body.

2. The aquatic apparatus of claim 1, wherein the at least five tail segments include the fore tail segment, an aft tail segment and a plurality of intermediate tail segments that are all hingedly attached in series, with the at least five tail segments each having respective interiors that diminish in size from the fore tail segment to the aft tail segment, and wherein the tail segments are hingedly attached at the forward and aft upper and lower hinge points so that movement of the articulated tail begins with the fore tail segment in response to yawing of the body followed by the plurality of intermediate tail segments and the aft tail segment in sequence from fore to aft.

3. The aquatic apparatus of claim 1 wherein the mechanical stop of each tail segment starts an adjacent tail segment pivoting about a vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction.

4. The aquatic apparatus of claim 3 wherein the mechanical stop comprises a leading edge side cut on each side of the at least five tail segments and a trailing edge side cut on each side of a plurality of the tail segments.

5. The aquatic apparatus of claim 4 wherein the mechanical stop on each tail segment is structured to start an adjacent tail segment pivoting about the vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction.

6. An aquatic apparatus, comprising:

a buoyant body having a front and a rear, a head at the front and a trunk at the rear, and two thrust generators within the body to drive the body through water;

an articulated tail depending from the rear of the body and having a longitudinal axis with a plurality of tail segments, including a first tail segment coupled to the rear of the body, a second tail segment coupled to the first tail segment, a third tail segment coupled to the second tail segment, a fourth tail segment coupled to the third tail segment, a fifth tail segment coupled to the fourth tail segment, a sixth tail segment coupled to the fifth tail segment, and a caudal fin coupled to the sixth tail segment that are all coupled in together with upper and lower vertically oriented hinges to enable lateral articulated movement of the articulated tail in a transverse plane;

each of the first through sixth tail segments has a hollow interior and a dorsal hinge connector and a pelvic hinge connector that respectively include a dorsal and pelvic hinge pin receivable within a respective dorsal and pelvic hinge receiver in an adjacent tail segment; the hinge pins and receivers are structured to provide a gap between each of the tail segments and an adjacent tail segment to permit the lateral articulated movement of the tail segments relative to one another and to the body and to permit water to flow through each gap and through the tail segments; and a body cavity cap fastened to the fourth tail segment in a manner that provides an airtight and watertight seal and creates a buoyancy chamber inside the fourth tail segment.

7. The aquatic apparatus of claim 6 wherein each of the first through sixth tail segments has a leading edge and a trailing edge, each of the leading edges having an angled face, the dorsal and pelvic hinge connectors are structured to have the dorsal and pelvic hinge connectors offset forward of a top and bottom section of the leading edge of each tail segment to creates gaps between each of the tail segments as well as the body and caudal fin that allow water to flow through the hollow interiors of the first through the sixth tail segments and past an exterior of the articulated tail exterior to stabilize the tail segments and resist turning or pivoting of the tail segments.

8. The aquatic apparatus of claim 7 wherein the first through sixth tail segments and the caudal fin are structured to cooperate with each other when assembled together and to the body to respond to water flowing through the tail segments and past the caudal fin and past the leading and trailing edges of each of the first through sixth tail segments to maintain stability and resist pivoting or turning of the tail segments about the hinge connectors when moving through the water such that in response to the body yawing in a first or second lateral direction, the plurality of tail segments will each turn or pivot in the same direction about the dorsal and pelvic hinge connectors in sequence from fore to aft to display coordinated lateral oscillation of the articulated tail.

9. The aquatic apparatus of claim 6 wherein each tail segment has a mechanical stop to start an adjacent tail segment pivoting about the vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction.

10. The aquatic apparatus of claim 9 wherein the mechanical stop comprises a leading edge side cut on each side of a plurality of the tail segments and a trailing edge side cut on each side of a plurality of the tail segments.

11. An aquatic apparatus, comprising: a buoyant body having a front and a rear; at least one thrust generator on the body to drive the body through water and to cause the body to yaw about a vertical axis; an articulated tail depending from the rear of the body, the articulated tail having a longitudinal axis and including a plurality of tail segments, each tail segment having a shaped leading edge and a shaped trailing edge, upper and lower aft hinge points, and upper and lower forward hinge points extending forward of the leading edge to couple to a respective upper and lower aft hinge point of an adjacent tail segment and providing a gap between each respective tail segment, the articulated tail comprising at least five tail segments depending from the rear of the body; and a buoyancy chamber formed in a fourth tail segment in the articulated tail and further comprising an airtight and water tight forward compartment in the body that includes air inside the forward compartment to provide buoyancy to the body.

12. The aquatic apparatus of claim 11 wherein each tail segment has a mechanical stop to start an adjacent tail segment pivoting about a vertical hinge in a first lateral direction in response to yawing of the body in the first lateral direction and to stop the adjacent tail segment from pivoting about the vertical hinge in its lateral travel in the first lateral direction and to start pivoting about the vertical hinge in a second lateral direction in response to yawing of the body in the second lateral direction.

13. The aquatic apparatus of claim 12 wherein the mechanical stop comprises a leading edge side cut on each side of a plurality of the tail segments and a trailing edge side cut on each side of a plurality of the tail segments.

14. The aquatic apparatus of claim 11, further comprising an electronic control system configured to control movement of the aquatic apparatus in water.

15. The aquatic apparatus of claim 14 wherein the control system includes an on-board controller coupled to the at least one thrust generator and configured to provide autonomous movement control of the aquatic apparatus.

16. The aquatic apparatus of claim 14 wherein the control system includes an on-board remote control system coupled to the at least one thrust generator and configured to enable wireless remote control aquatic apparatus.

17. The aquatic apparatus of claim 14 comprising a pair of side-by-side motors mounted in the body and coupled to respective propellers to provide thrust and differential control for the aquatic apparatus.

* * * * *